US007581922B1

(12) United States Patent
Morimoto et al.

(10) Patent No.: US 7,581,922 B1
(45) Date of Patent: Sep. 1, 2009

(54) TURBINE CASING STRUCTURE

(75) Inventors: Hitoshi Morimoto, Takasago (JP); Taichi Ozaki, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 421 days.

(21) Appl. No.: 11/344,340

(22) Filed: Feb. 1, 2006

(30) Foreign Application Priority Data

May 16, 2005 (JP) ..... 2005-142140

(51) Int. Cl.
*F01D 25/24* (2006.01)

(52) U.S. Cl. ..... 415/126; 415/220

(58) Field of Classification Search ..... 415/126, 415/214.1, 215.1, 220
See application file for complete search history.

(56) References Cited

U.S. PATENT DOCUMENTS

| | | | | |
|---|---|---|---|---|
| 2,936,999 | A * | 5/1960 | Jacobus et al. | 415/134 |
| 4,441,313 | A * | 4/1984 | Joubert et al. | 60/262 |
| 5,046,961 | A * | 9/1991 | Hoffman | 439/141 |
| 6,297,741 | B1 * | 10/2001 | Higgins | 340/631 |
| 6,752,591 | B2 * | 6/2004 | Hain | 415/136 |
| 6,963,396 | B2 * | 11/2005 | Kimberlin | 356/237.6 |

FOREIGN PATENT DOCUMENTS

| | | |
|---|---|---|
| CA | 2 322 401 A1 | 4/2001 |
| DE | 2532537 A1 | 1/1977 |
| EP | 0934456 B1 | 4/2004 |
| JP | 9-112204 | 4/1997 |
| JP | 2001-107922 | 4/2001 |
| JP | 2004-162536 | 6/2004 |

OTHER PUBLICATIONS

German Patent Office Action, Application No. 102006007088.7, dated Dec. 1, 2008, with English language translation.

* cited by examiner

*Primary Examiner*—Edward Look
*Assistant Examiner*—Sean J Younger
(74) *Attorney, Agent, or Firm*—Westerman, Hattori, Daniels & Adrian, LLP.

(57) ABSTRACT

A turbine casing structure having an outer casing, and an inner casing disposed in the outer casing, comprising:

a bush disposed in a concave portion formed in the inner casing;

an eccentric shaft inserted into a communication hole formed in the outer casing, and having a front end disposed in contact with the bush; and a fixing member disposed in engagement with the eccentric shaft, and fixed to the outer casing.

3 Claims, 10 Drawing Sheets

FIG. 7A

If eccentricity is present on upstream side

| Amount of vertical movement ( eccentric amount 0.8 ) | | 0 | 0.06 | 0.12 | 0.18 | 0.23 | 0.29 | 0.34 | 0.39 | 0.44 | 0.49 | 0.54 | 0.58 | 0.62 | 0.65 | 0.68 | 0.71 | 0.73 | 0.75 | 0.77 | 0.78 | 0.79 | 0.79 |
|---|---|---|---|---|---|---|---|---|---|---|---|---|---|---|---|---|---|---|---|---|---|---|---|
| Upward movement | Combination No. | 1 | 2 | 3 | 4 | 5 | 6 | 7 | 8 | 9 | 10 | 11 | 12 | 13 | 14 | 15 | 16 | 17 | 18 | 19 | 20 | 21 | 22 |
| | Symbol of cover member on turbine casing reference axis | A | D | G | C | F | B | E | A | D | G | C | F | B | E | A | D | G | C | F | B | E | A |
| | Symbol of eccentric shaft in alignment with confirmation hole | a | h | c | k | e | m | g | b | j | d | l | f | a | h | c | k | e | m | g | b | j | d |
| Downward movement | Combination No. | 23 | 24 | 25 | 26 | 27 | 28 | 29 | 30 | 31 | 32 | 33 | 34 | 35 | 36 | 37 | 38 | 39 | 40 | 41 | 42 | 43 | 44 |
| | Symbol of cover member on turbine casing reference axis | A | E | B | F | C | G | D | A | E | B | F | C | G | D | A | E | B | F | C | G | D | A |
| | Symbol of eccentric shaft in alignment with confirmation hole | a | f | l | d | j | b | g | m | e | k | c | h | a | f | l | d | j | b | g | m | e | k |

FIG. 7B

If eccentricity is present on downstream side

| Amount of vertical movement ( eccentric amount 0.8 ) | | 0 | 0.06 | 0.12 | 0.18 | 0.23 | 0.29 | 0.34 | 0.39 | 0.44 | 0.49 | 0.54 | 0.58 | 0.62 | 0.65 | 0.68 | 0.71 | 0.73 | 0.75 | 0.77 | 0.78 | 0.79 | 0.79 |
|---|---|---|---|---|---|---|---|---|---|---|---|---|---|---|---|---|---|---|---|---|---|---|---|
| Upward movement | Combination No. | 45 | 46 | 47 | 48 | 49 | 50 | 51 | 52 | 53 | 54 | 55 | 56 | 57 | 58 | 59 | 60 | 61 | 62 | 63 | 64 | 65 | 66 |
| | Symbol of cover member on turbine casing reference axis | A | E | B | F | C | G | D | A | E | B | F | C | G | D | A | E | B | F | C | G | D | A |
| | Symbol of eccentric shaft in alignment with confirmation hole | g | m | e | k | c | h | a | f | l | d | j | b | g | m | e | k | c | h | a | f | l | d |
| Downward movement | Combination No. | 67 | 68 | 69 | 70 | 71 | 72 | 73 | 74 | 75 | 76 | 77 | 78 | 79 | 80 | 81 | 82 | 83 | 84 | 85 | 86 | 87 | 88 |
| | Symbol of cover member on turbine casing reference axis | A | D | G | C | F | B | E | A | D | G | C | F | B | E | A | D | G | C | F | B | E | A |
| | Symbol of eccentric shaft in alignment with confirmation hole | g | b | j | d | l | f | a | h | c | k | e | m | g | b | j | d | l | f | a | h | c | k |

TURBINE CASING STRUCTURE

BACKGROUND OF THE INVENTION

1. Field of the Invention

This invention relates to the turbine casing structure of a turbine, such as a gas turbine or a steam turbine.

2. Description of the Related Art

With a turbine such as an industrial gas turbine or steam turbine of a large size, its interior is at a high temperature. Thus, a temperature difference between its interior and its exterior exerts a great influence. As a result, thermal deformation of the stationary portion occurs, causing oval deformation, etc. and thus necessitating a larger gap between the stationary side (stationary blades assembled to an inner casing to be described later) and the rotating side (moving blades assembled to a rotor). To diminish the thermal influence, use is made of a structure of a turbine casing in whose interior a casing (inner casing) is further provided (namely, a double-casing structure). This structure has a single air layer provided between a gas channel portion, through which a high temperature gas flows, and the air outside the turbine casing.

The inner casing has a structure supporting the blades on the stationary side, and the inner casing is supported by and fixed to an outer casing.

An example of a turbine having such a structure is a turbine having a turbine casing structure 30 as shown in FIG. 10. With the turbine casing structure 30, supporting and positioning (alignment adjustment) of an inner casing (blade ring) 32 with respect to an outer casing 31 are performed by torque pins 33 in a right-and-left direction (lateral direction), and by horizontal keys 34 in an up-and-down direction (vertical direction), respectively, when viewed from the upstream side of the turbine. As shown in FIG. 11, the horizontal key 34 is fixed to a parting surface 32*b* of a lower-half inner casing 32*a* by a bolt 35, and has a front end portion 34*a* installed between an upper liner 36 and a lower liner 37 provided in the vicinity of a parting surface 31*a* of the outer casing 31.

Another example of a turbine having the aforementioned double-casing structure is a turbine having a positioning mechanism for a turbine casing as described in Japanese Patent Application Laid-Open No. 2004-162536 (hereinafter referred to as Patent Document 1). With this turbine casing positioning mechanism, an eccentric pin is inserted into an adjusting hole formed in an engine casing (outer casing) A trunk portion of the eccentric pin is disposed in the adjusting hole, while a front end portion of the eccentric pin eccentric with respect to the trunk portion is disposed in an adjusting groove formed in the turbine casing (inner casing) while extending in an axial direction. A parallel pin is mounted to whirl-stop the eccentric pin with respect to the adjusting hole, and the eccentric pin is fixed to the engine casing by a cover body disposed in contact with the head of the eccentric pin.

Japanese Patent Application Laid-Open No. 2001-107922 (hereinafter referred to as Patent Document 2) discloses a flangeless casing fastening structure for fastening upper and lower casings. With the flangeless casing fastening structure, bolt holes are formed in the upper and lower casings, and a cylindrical sleeve is mounted by screwing an outside screw, which is formed in an outer periphery thereof, into a tapped hole provided in the vicinity of a joining surface at the bolt hole of the upper casing. A large-diameter portion to be joined to an upper end surface of the sleeve when a bolt is fastened into the bolt hole of the lower casing is formed in the bolt, and the bolts are inserted into the bolt holes to fix the upper and lower casings.

Japanese Patent Application Laid-Open No. 1997-112204 (Patent Document 3) discloses an upper-lower bolt tightening structure for coupling type 180°-divided stationary blades which fixes a stationary blade ring to a turbine casing. With the upper-lower bolt tightening structure for coupling type 180°-divided stationary blades, upper and lower stationary blades are integrated by bolts with holes, and keys fixed in the holes of the bolts with the holes are disposed between upper and lower liners provided in the turbine casing to fix the stationary blade ring to the turbine casing.

With the aforementioned turbine casing structure 30, an improvement in the accuracy of setting a clearance between the rotating side and the stationary side has been desired in recent years from the aspects of improved performance and reliability. Thus, after the inner casing 32 is mounted in the outer casing 31, the clearance between the inner casing 32 and the outer casing 31 is measured. If the measured value is not within the tolerance of the design value, the inner casing 32 is taken out of the outer casing 31, and the horizontal keys 34 are machined to optimize the clearance. Using the machined horizontal keys 34, the inner casing 32 is assembled again into the outer casing 31. With the conventional turbine casing structure 30, therefore, the position in the up-and-down direction (vertical direction) of the inner casing 32 with respect to the outer casing 31 cannot be adjusted from the outside. This poses the problem of impairing the efficiency of an adjusting operation, thereby increasing the cost of the operation.

With the turbine casing positioning mechanism described in Patent Document 1, the positioning mechanisms are disposed at upper and lower portions of the engine casing and the turbine casing, whereby the position in the right-and-left direction of the turbine casing with respect to the engine casing is restrained by the upper portion and the lower portion thereof. Thus, even if the turbine casing is thermally expanded, its central position is not displaced in the right-and-left direction with respect to the engine casing, and the concentric relationship between the engine casing and the turbine casing can be maintained. Even with the use of this positioning mechanism, however, the position in the up-and-down direction of the turbine casing with respect to the engine casing cannot be adjusted. Even if the positioning mechanisms are disposed in the vicinity of the parting surfaces of the engine casing and the turbine casing, the position in the up-and-down direction of the turbine casing with respect to the engine casing cannot be adjusted. With the turbine casing positioning mechanism, therefore, like the turbine casing structure 30, the optimal adjustment of the clearance between the engine casing and the turbine casing requires that the turbine casing be taken out of the engine casing, and the positioning mechanism and the positioning mechanism for the vertical position be machined for adjustment. This poses the problem that the position in the up-and-down direction of the turbine casing with respect to the engine casing cannot be adjusted from the outside.

With the flangeless casing fastening structure described in Patent Document 2, the inner casings or the outer casings divided into upper and lower portions can be coupled. However, the problem arises that the position in the up-and-down direction of the inner casing with respect to the outer casing cannot be adjusted from the outside.

With the upper-lower bolt tightening structure for coupling type 180°-divided stationary blades described in Patent Document 3, the keys fixed to the hole-formed bolts coupling the upper-half and lower-half stationary blades are disposed between the upper and lower liners provided in the turbine casing. By so doing, the inner casing can be locked at a predetermined position with respect to the outer casing. However, the adjustment of the position in the up-and-down direction of the inner casing with respect to the outer casing requires machining of the keys. This presents the problem that the position in the up-and-down direction of the inner casing with respect to the outer casing cannot be adjusted from the outside.

The present invention has been accomplished in light of the above-described problems. It is an object of the invention to provide a turbine casing structure in which the position in the up-and-down direction of the inner casing with respect to the outer casing can be adjusted from the outside.

SUMMARY OF THE INVENTION

An aspect of the present invention is a turbine casing structure having an outer casing, and an inner casing disposed in the outer casing, comprising:

a bush disposed in a concave portion formed in the inner casing;

an eccentric shaft inserted into a communication hole formed in the outer casing, and having a front end disposed in contact with the bush; and a fixing member disposed in engagement with the eccentric shaft, and fixed to the outer casing.

An example of the eccentric shaft is a shaft having a shaft center on the front end side thereof and a shaft center on the head side thereof eccentric with respect to each other.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 7(*a*) and 7(*b*) are views, in tabular form, showing the relationship between an engagement combination of the cover member and an eccentric shaft possessed by the turbine casing structure according to the first embodiment of the present invention, and the amount of movement in the up-and-down direction (vertical movement) of an inner casing;

DETAILED DESCRIPTION OF THE INVENTION

The best mode for putting the turbine casing structure according to the present invention into practice will be described in detail based on the following embodiments with reference to the accompanying drawings.

First Embodiment

Figure 1:
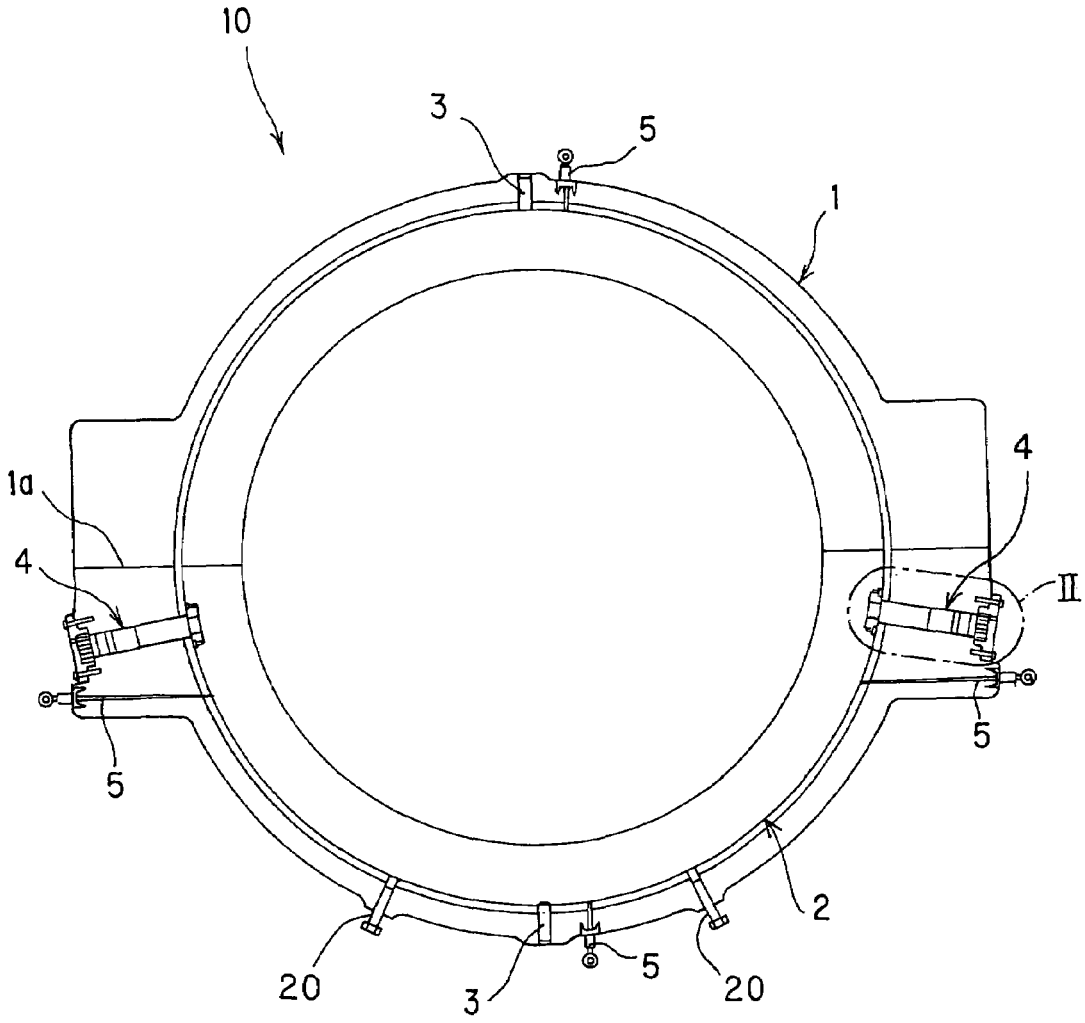
FIG. 1 is a schematic sectional view of a turbine having a turbine casing structure according to a first embodiment of the present invention applied thereto.
Figure 2:
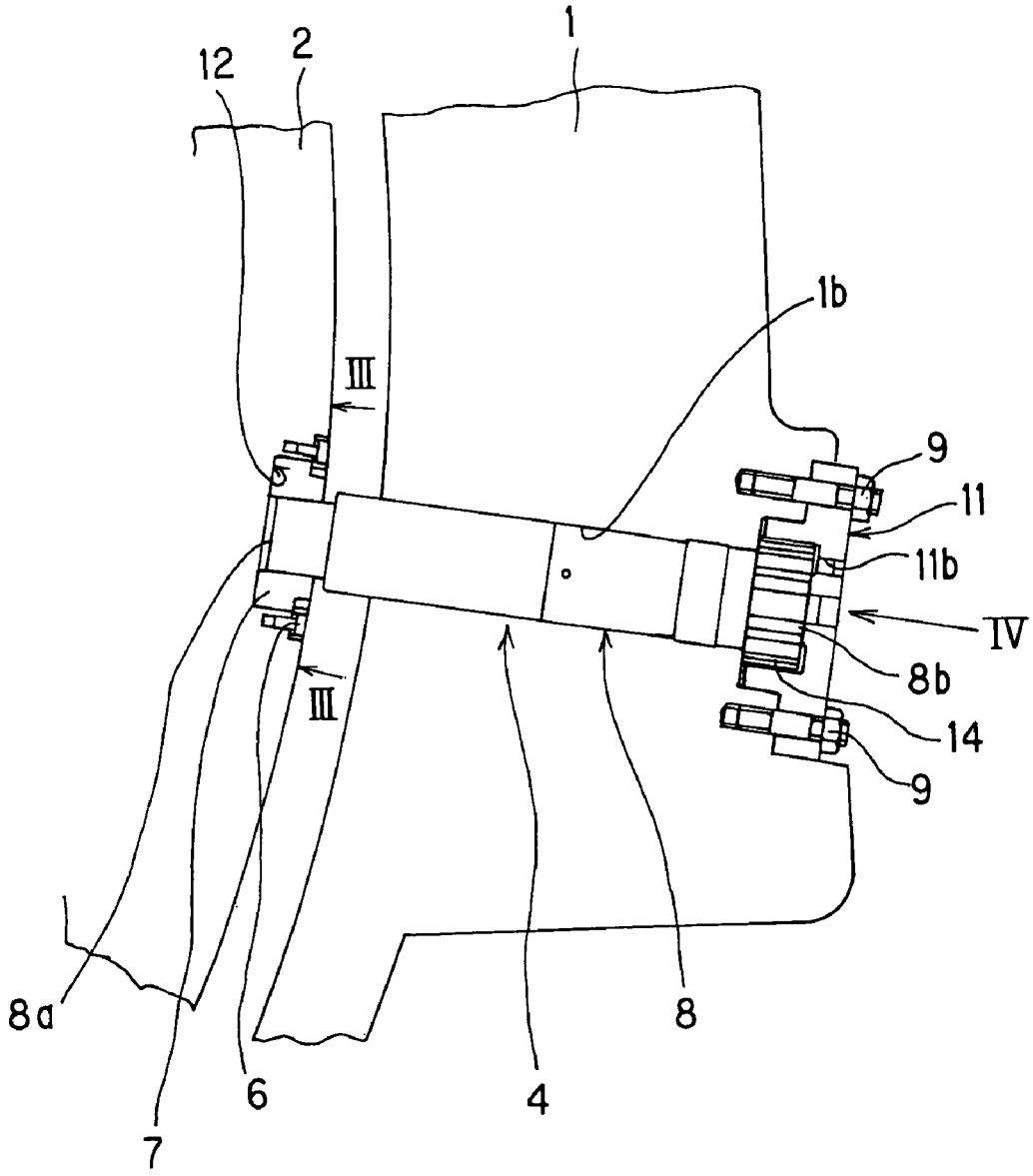
FIG. 2 is an enlarged view of a portion enclosed with a line II in FIG. 1.
Figure 3:
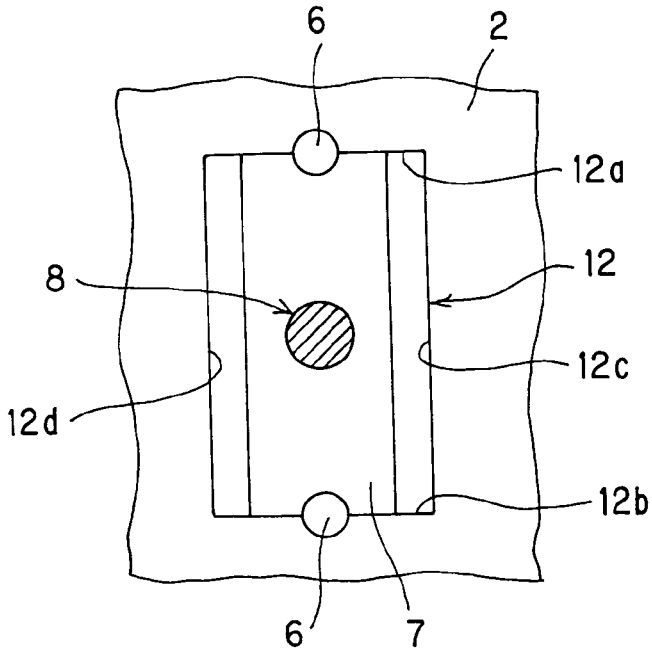
FIG. 3 is a view taken on line III-III in FIG. 2.
Figure 4:
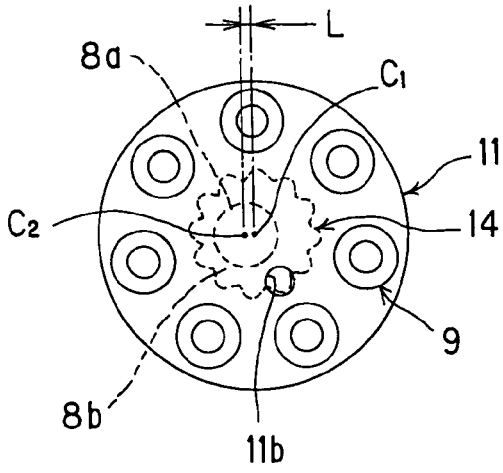
FIG. 4 is a view taken along line IV in FIG. 2.
Figure 5:
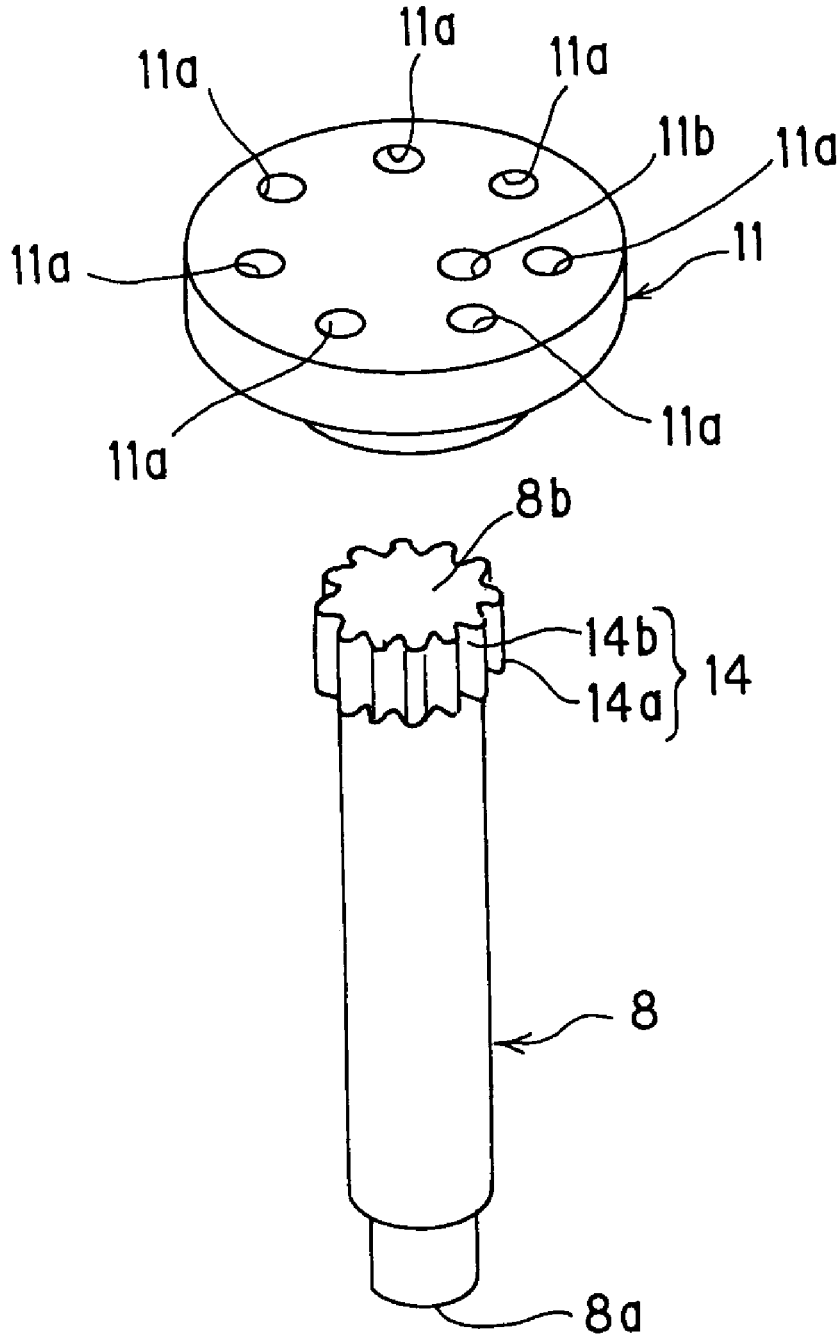
FIG. 5 is an explanation drawing of a position adjusting mechanism possessed by the turbine casing structure according to the first embodiment of the present invention.
Figure 6:
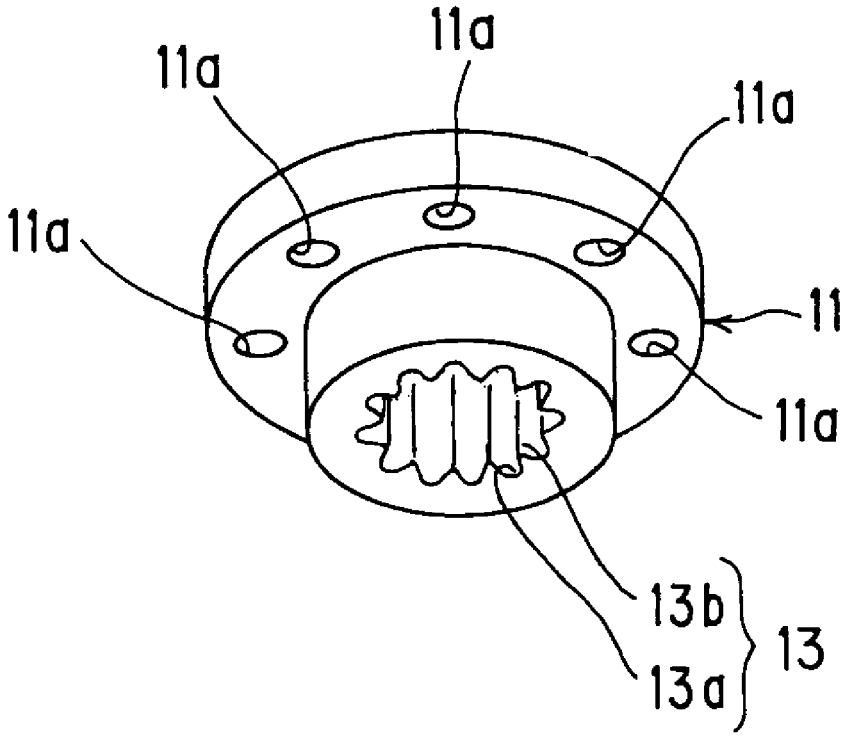
FIG. 6 is a bottom view of a cover member possessed by the turbine casing structure according to the first embodiment of the present invention.
Figure 8:
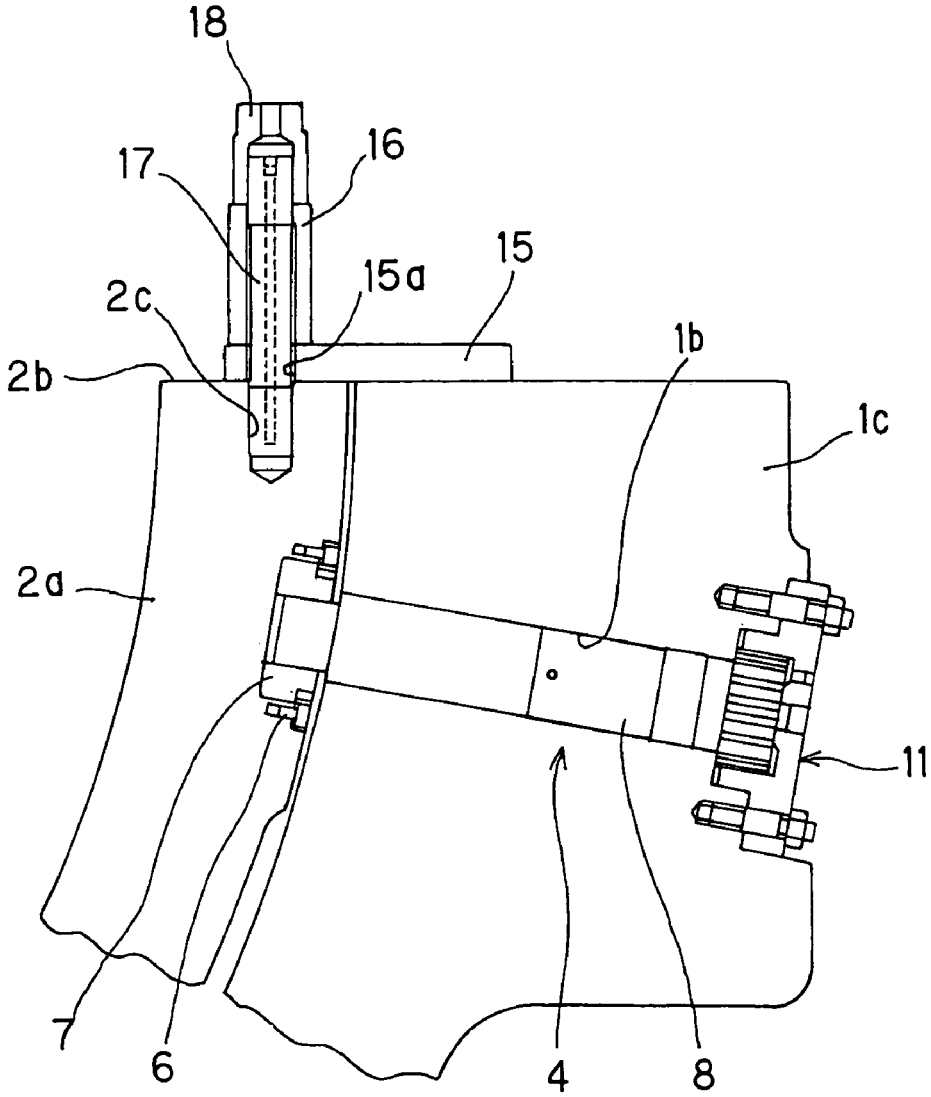
FIG. 8 is a view showing the state of assemblage of the turbine casing structure according to the first embodiment of the present invention.
Figure 9:
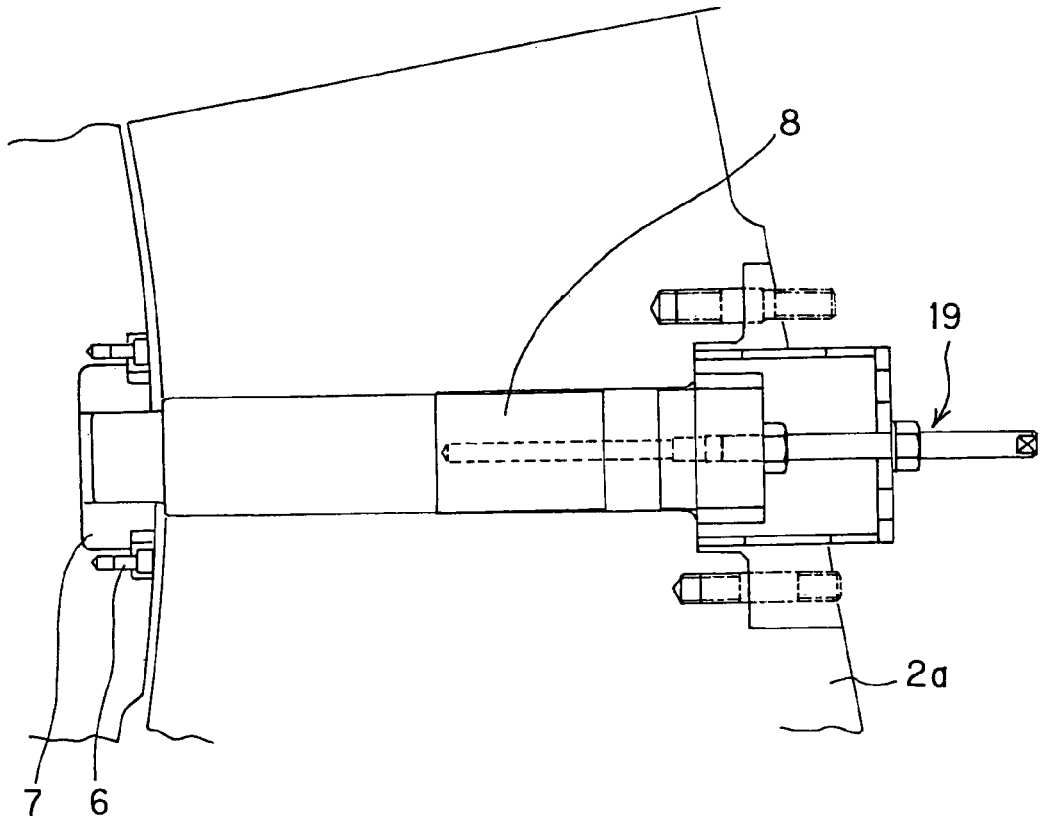
FIG. 9 is a side view of a shaft adjusting jig for the eccentric shaft which is possessed by the turbine casing structure according to the first embodiment of the present invention.
Figure 10:
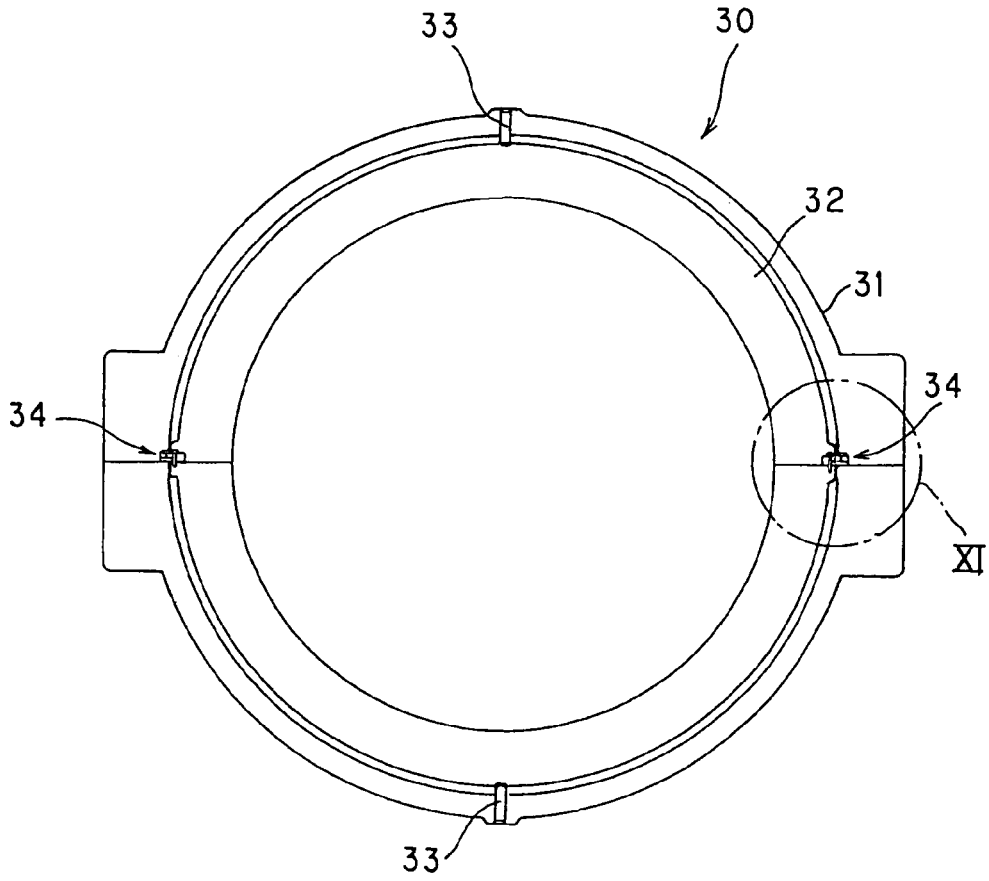
PRIOR ART FIG. 10
FIG. 10 is a schematic sectional view of a turbine having a conventional turbine casing structure applied thereto.
Figure 11:
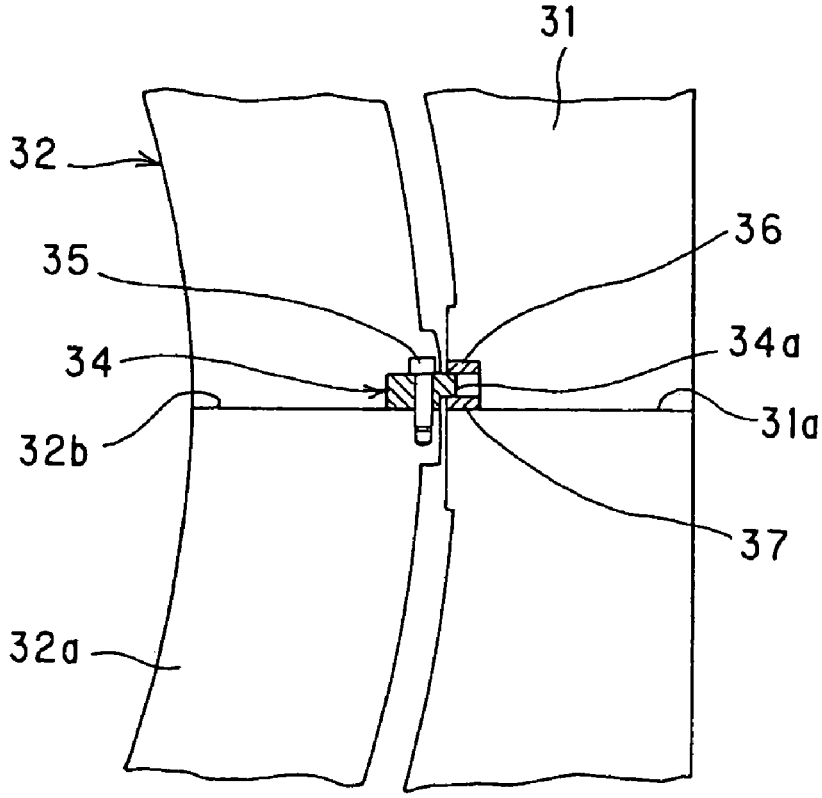
PRIOR ART FIG. 11
FIG. 11 is an enlarged view of a portion encircled with line XI in FIG. 10.

FIG. 1 is a schematic sectional view of a turbine having a turbine casing structure according to the first embodiment of the present invention applied thereto. FIG. 2 is an enlarged view of a portion enclosed with line II in FIG. 1. FIG. 3 is a view taken on line III-III in FIG. 2. FIG. 4 is a view taken along line IV in FIG. 2. FIG. 5 is an explanation drawing of a position adjusting mechanism possessed by the turbine casing structure. FIG. 6 is a bottom view of a cover member possessed by the turbine casing structure. FIGS. 7(*a*) and 7(*b*) are views, in tabular form, showing the relationship between an engagement combination of the cover member and an eccentric shaft possessed by the turbine casing structure, and the amount of vertical movement of an inner casing, FIG. 7(*a*) showing a case where the eccentric position of the eccentric shaft (the position of the shaft center of a front end portion with respect to the shaft center of a head portion) is located on an upstream side, and FIG. 7(*b*) showing a case where the eccentric position of the eccentric shaft is located on a downstream side. FIG. 8 is a view showing the state of assemblage of the turbine casing structure. FIG. 9 is a side view of a shaft adjusting jig for the eccentric shaft which the turbine casing structure has.

A turbine casing structure 10, as shown in FIG. 1, has an outer casing 1 divided into two portions, i.e., an upper portion and a lower portion, and an inner casing 2 disposed within the outer casing 1 and divided into two portions, i.e., an upper portion and a lower portion. When viewed from the upstream side of a turbine, torque pins (circumferential movement restraining means) 3 are mounted on the upper portion and the lower portion of the outer casing 1. Position adjusting mechanisms 4 are mounted in the vicinity of a parting surface 1*a* in the lower half of the outer casing 1, and in right-hand and left-hand opposite side portions of the outer casing 1 when viewed from the upstream side of the turbine. A plurality of stationary blades (not shown), which are arranged between moving blades (not shown) rotatably supporting a rotor (not shown) and assembled in multiple stages to the rotor, are assembled to the inner casing 2.

The torque pins 3 adjust the position in the right-and-left direction of the inner casing 2 with respect to the outer casing 1 to restrain the movement in the circumferential direction of the inner casing 2 with respect to the outer casing 1. The position adjusting mechanisms 4 adjust the position in the up-and-down (vertical) direction of the inner casing 2 with respect to the outer casing 1. Measuring gauges 5, which measure the position of the inner casing 2 with respect to the outer casing 1, are mounted in the vicinity of the torque pins 3 and the position adjusting mechanisms 4.

As shown in FIGS. 2 to 4, the position adjusting mechanism 4 has a bush 7 disposed in a concave portion 12 depressed toward the interior of the inner casing 2, an eccentric shaft 8 which is inserted into a communication hole 1*b* formed opposite the concave portion 12 of the inner casing 2 for establishing communication between the inside and outside of the casing and which has a front end 8*a* located in contact with the bush 7, and a cover member 11 as a fixing member which is disposed in contact with a head 8*b* of the eccentric shaft 8 and fixed to the outer casing 1 by bolts 9. As shown in FIG. 3, the bush 7 is fixed into the concave portion 12 by bolts 6 and thereby inhibited from being dislodged from the concave portion 12, and is in such a shape as to contact an upper part 12*a* and a lower part 12*b* of the concave portion 12 of the inner casing 2, but not to contact side parts 12*c*, 12*d* of the concave portion 12. Thus, the bush 7 is configured to be inhibited from moving in the up-and-down direction within the concave portion 12, but be free to move in the right-and-left direction within the concave portion 12.

The cover member 11 has bolt holes 11*a* for insertion of the bolts 9, and an engaging portion 13 for engagement with an engaged portion 14 of the eccentric shaft 8 to be described later, as shown in FIGS. 2 and 4 to 6. The bolt holes 11*a* are formed at predetermined intervals along the outer periphery of the cover member 11, and seven of the bolt holes 11*a* are formed here. The engaging portion 13 of the cover member 11 is tubular, and is formed in the interior of the cover member 11. The engaging portion 13 consists of convexities 13*a* convex outward, and concavities 13*b* located between the adjacent convexities 13*a*. In the engaging portion 13, twelve of the convexities 13*a* and twelve of the concavities 13*b* are formed. A confirmation hole 11*b* is formed in the cover member 11, and this hole 11*b* makes it possible to confirm letters described on the head 8*b* of the eccentric shaft 8 in correspondence with shaft convexities 14*a* of the engaged portion 14 of the eccentric shaft 8.

As shown in FIG. 5, the engaged portion 14 to be brought into engagement with the engaging portion 13 of the cover member 11 is formed in the head 8*b* of the eccentric shaft 8. The engaged portion 14 of the eccentric shaft 8 is in the shape of a gear consisting of the shaft convexities 14*a* convex outward, and shaft concavities 14*b* located between the adjacent shaft convexities 14*a*. In the engaged portion 14, twelve each of the shaft convexities 14*a* and the shaft concavities 14*b* are formed. However, the shaft center $C_1$ of the head 8*b* of the eccentric shaft 8 is eccentric by a distance L with respect to the shaft center $C_2$ of the front end 8*a*, as shown in FIG. 4. Here, the distance L is 0.8 mm.

Thus, according to the eccentric shaft 8 having such a shape, when the eccentric shaft 8 is rotated, the front end 8*a* of the eccentric shaft 8 draws a circle of a predetermined size (i.e., the front end 8*a* moves in the right-and-left direction and the up-and-down direction). At the front end 8*a* of the eccentric shaft 8, its movement in the right-and-left direction is cancelled by the bush 7, but its movement in the up-and-down direction acts on the inner casing 2 via the bush 7, so that the position in the up-and-down direction of the inner casing 2 with respect to the outer casing 1 can be adjusted from the outside. As a result, the work efficiency can be increased.

One of the bolt holes, 11*a*, and the confirmation hole 11*b* of the cover member 11 are located in the direction of 12 o'clock, and the shaft center $C_2$ of the front end 8*a* of the eccentric shaft 8 is located in the direction of 9 o'clock. In this state, the bolt hole 11*a* located in the direction of 12 o'clock (the direction of the turbine casing reference axis) is designated as A, and the shaft convexity 14*a* located in the same direction (visible through the confirmation hole 11*b*) is designated as a. The respective bolt holes 11*a* are sequentially marked the symbols A to G counterclockwise. Similarly, the respective shaft convexities 14*a* are sequentially marked the symbols a to h and j to m counterclockwise.

The procedure for assembling the turbine casing structure 10 according to the first embodiment of the present invention will be described below.

(1) First, as shown in FIG. 8, a holding plate 15 is disposed in contact with a parting surface 2*b* of a lower-half inner casing 2*a*. Also, a bolt hole 2*c* formed in the parting surface 2*b* of the lower-half inner casing 2*a* and a through-hole 15*a* formed in the holding plate 15 are disposed in alignment with each other, and a collar 16 as a tubular body is inserted into the through-hole 15*a* and the bolt hole 2*c*. Then, a bolt 17 is inserted into the collar 16 and the bolt hole 2*c*, and a cap nut 18 is attached to the head of the bolt 17 to fix the holding plate 15 to the lower-half inner casing 2*a*. The lower-half inner casing 2*a* having the holding plate 15 fixed thereto in this manner is assembled to a lower-half outer casing 1*c*.

(2) Then, as shown in FIGS. 2 and 8, the eccentric shaft 8 and the cover member 11 are temporarily assembled. That is, the eccentric shaft 8 is inserted into the communication hole 1*b* of the outer casing 1, and its front end 8*a* is brought into contact with the bush 7 disposed in the concave portion 12 of the inner casing 2. The engaging portion 13 of the cover member 11 is engaged with the engaged portion 14 of the eccentric shaft 8, and the cover member 11 is fixed to the outer casing 1 by the bolts 9. At this time, the position of the symbol d of the eccentric shaft 8 (eccentric position of the eccentric shaft 8) is confirmed.

(3) The current combination of the engaged portion 14 of the eccentric shaft 8 and the engaging portion 13 of the cover member 11 is recorded.

(4) Then, the holding plate 15, the collar 16 and the cap nut 18 are detached from the lower-half inner casing 2*a*, an upper-half inner casing is assembled to the lower-half inner casing 2*a*, and an upper-half outer casing is assembled to the lower-half outer casing 1*c*.

(5) Then, the cover member 11 is detached and, as shown in FIG. 9, a shaft adjusting jig 19 capable of adjusting the position of the eccentric shaft 8 is assembled to the eccentric shaft 8.

Next, an explanation will be offered for the procedure for adjusting the position in the up-and-down direction of the inner casing 2 by the position adjusting mechanism 4 possessed by the turbine casing structure according to the first embodiment of the present invention.

(i) The amount of vertical movement (movement in the up-and-down direction), which is the closest to the required amount of movement, is read from the tables described in FIGS. 7(*a*), 7(*b*), and recorded. That is, if the eccentric position of the eccentric shaft 8 is located on the upstream side when viewed from the upstream side of the turbine during temporary assemblage of the eccentric shaft 8 and the cover member 11, the amount of vertical movement is read from the table in FIG. 7(*a*) and recorded. If the eccentric position of the eccentric shaft 8 is located on the downstream side, on the other hand, the amount of vertical movement is read from the table in FIG. 7(*b*) and recorded.

(ii) The current position of the inner casing 2 is measured with the measuring gauge 5, and recorded.

(iii) Then, the inner casing 2 is supported by push-up bolts 20, the push-up bolts 20 are fixed to the outer casing 1, and the eccentric shaft 8 and the cover member 11 are detached from the outer casing 1.

(iv) Then, the amount of vertical movement is confirmed and, with the measuring gauge being seen, the inner casing 2 is moved by the push-up bolts 20.

(v) Then, the eccentric shaft 8 and the cover member 11 are assembled so that their combination coincides with the engagement combination No. recorded in (i). If it is difficult to assemble the eccentric shaft 8 and the cover member 11 as in the tabulated combination, however, the position of the inner casing 2 may be adjusted using the push-up bolts 20.

(vi) Upon completion of the operation for adjusting the position in the up-and-down direction of the inner casing 2 with respect to the outer casing 1, a stop plug (not shown) or the like is assembled into the confirmation hole 11*b* of the cover member 11.

According to the turbine casing structure 10 concerned with the first embodiment of the present invention, therefore, the position in the circumferential direction of the eccentric shaft 8 is adjusted, and fixed by the cover member 11. By so doing, at the front end 8*a* of the eccentric shaft 8, its movement in the right-and-left direction is cancelled by the bush 7, but its movement in the up-and-down direction acts on the inner casing 2 via the bush 7. Thus, the position in the up-and-down direction of the inner casing 2 with respect to the outer casing 1 can be adjusted from the outside. As a result, the work efficiency can be increased. Moreover, the eccentric amount of the eccentric shaft 8, and the combination of the engaged portion 14 of the eccentric shaft 8 and the engaging portion 13 of the cover member 11 are recorded during manufacture, whereby the turbine casing structure can be easily assembled in the same state as that during manufacture when the turbine is installed in situ. Furthermore, the position in the up-and-down direction of the inner casing 2 with respect to the outer casing 1 can be set with high accuracy. Since the position of the engaged portion 14 of the eccentric shaft 8 can be confirmed through the confirmation hole 11*b*, the combination of the engaged portion 14 and the engaging portion 13 of the cover member 11 can be easily adjusted, thus increasing the work efficiency.

The above descriptions have been offered in connection with the use of the cover member 11 which is disposed in engagement with the head 8*b* of the eccentric shaft 8 and is fixed to the outer casing 1. However, any member, which can engage and stop the eccentric shaft 8 and can be fixed to the outer casing 1, is acceptable. If the eccentric amount of the eccentric shaft 8 is increased, the range of vertical movement of the inner casing 2 with respect to the outer casing 1 can be expanded. If the numbers of the convexities and the concavities of the engaging portion 13 of the cover member 11 and the convexities and the concavities of the engaged portion 14 of the eccentric shaft 8 are increased, the inner casing 2 can be adjusted with a fine pitch within the above range of vertical movement. If the numbers of the convexities and the concavities of the engaging portion 13 of the cover member 11 and the convexities and the concavities of the engaged portion 14 of the eccentric shaft 8 are decreased, the inner casing 2 can be adjusted with a rough pitch within the above range of vertical movement.

As described above, the present invention can be used for a turbine casing structure.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A turbine casing structure having an outer casing, and an inner casing disposed in the outer casing, comprising:

a bush disposed in a concave portion formed in the inner casing and in such a shape as to contact an upper part and a lower part of the concave portion, but not to contact side parts of the concave portion;

an eccentric shaft inserted into a communication hole formed in the outer casing, and having a front end disposed in contact with the bush; and a fixing member disposed in engagement with the eccentric shaft, and fixed to the outer casing, wherein a left-right movement of a front end of the shaft is cancelled by the bush, and up-down movement of the front end of the shaft acts on the inner casing via the bush so that the position of the shaft in the up-down direction of the inner casing with respect to the outer casing is adjustable from outside the turbine casing structure.

2. The turbine casing structure according to claim 1, wherein the fixing member has an engaging portion formed in the eccentric shaft.

3. The turbine casing structure according to claim 1, wherein a confirmation hole is formed in the fixing member.

* * * * *

UNITED STATES PATENT AND TRADEMARK OFFICE

CERTIFICATE OF CORRECTION

PATENT NO. : 7,581,922 B1
APPLICATION NO. : 11/344340
DATED : September 1, 2009
INVENTOR(S) : Morimoto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 516 days.

Signed and Sealed this

Fourteenth Day of September, 2010

David J. Kappos

David J. Kappos
*Director of the United States Patent and Trademark Office*